United States Patent [19]

Larson

[11] Patent Number: 4,793,875

[45] Date of Patent: Dec. 27, 1988

[54] ABRASION RESISTANT CASTING ALLOY FOR CORROSIVE APPLICATIONS

[75] Inventor: John A. Larson, Easton, Pa.

[73] Assignee: Ingersoll-Rand Company, Woodcliff Lake, N.J.

[21] Appl. No.: 68,372

[22] Filed: Jul. 1, 1987

[51] Int. Cl.[4] ..... C22C 38/20

[52] U.S. Cl. ..... 148/326; 148/325; 417/DIG. 1

[58] Field of Search ..... 148/325, 327, 326, 144, 148/143; 420/66, 68, 69, 61; 417/DIG. 1

[56] References Cited

U.S. PATENT DOCUMENTS 3,876,475 4/1975 Ramquist ..... 420/61

3,926,685 12/1975 Gueussier et al. ..... 148/325

FOREIGN PATENT DOCUMENTS 803816 11/1958 United Kingdom ..... 148/326

*Primary Examiner*—Deborah Yee

*Attorney, Agent, or Firm*—Walter C. Vliet

[57] ABSTRACT

Disclosed is an abrasion corrosion resistant casting alloy which is readily machinable and of an approximately 50/50 mixture of austenite and ferrite obtained by uniquely heat treating a new thirty percent (30%) chromium, five percent (5%) manganese, three percent (3%) silicon, two percent (2%) molybdenum, one and one half percent (1½%) copper plus additions of titanium, vanadium, carbon and nitrogen.

10 Claims, 2 Drawing Sheets a) ASTM A532 Class III 25 % Cr Alloy b) New Alloy

ABRASION RESISTANT CASTING ALLOY FOR CORROSIVE APPLICATIONS

BACKGROUND OF THE INVENTION

The most commonly used cast materials for abrasive applications are those contained in ASTM A532, "Abrasion-Resistant Cast Irons". Although there are a number of grades within some of the classifications, the alloys are grouped into three main classes as follows:

| ASTM Class | Comments |
|---|---|
| Class I | These are lower chromium cast irons containing 1 to 11% chromium and 3–7% nickel, commonly referred to as NI-Hard. |
| Class II | These are higher chromium cast irons containing 11 to 23% chromium, with the addition of 0.5 to 3.5% molybdenum, commonly referred to as moly alloyed high chromium irons. |
| Class III | These are the straight high chromium cast irons containing 23 to 28% chromium. They are commonly referred to as the 25 chrome irons. |

Class I alloys (Ni-Hard) containing 3–7% nickel are heat treated to be essentially martensitic (some retained austenite may be present), with chromium and iron carbides. They have a typical Brinell hardness of 500–600. The most common grade is Type D, sometimes called Type 4, containing about 9% chromium.

Class II alloys containing molybdenum also are essentially martensitic after heat treatment, with chromium and iron carbides.

However, Class II alloys can be annealed to reduce the hardness to about 450 Brinell for limited machining.

Class III alloys are essentially martensitic when heat treated, containing chromium and iron carbides. However, in section thicknesses over about two inches, these cast irons are partially or wholly pearlitic. Although this increases the impact resistance, the wear resistance is reduced. As with the Class II alloys, these 25 chromium irons can be annealed for machining. In the hardened condition, they have a Brinell hardness of about 550 to 600.

In general, it should be stressed that these three classes of materials, even with those that can be annealed, machining is next to impossible and welding should never be allowed. Also, although there is a trade off between carbon and chromium (as the carbon is reduced, more chromium is available for corrosion resistance), in general the corrosion resistance is not very good, particularly at low pH values. Unfortunately, some of the more recent applications for slurry pumps such as used in scrubbers, contain liquids having low pH values (less than 4).

It should be noted that other materials have been used for abrasive applications where corrosion is a problem, with one of the more popular being the duplex stainless steel alloy CD-4MCu which can behardened to about 300–325 Brinell with an aging treatmet. Although expensive, the cobalt base Stellite alloys have excellent abrasion resistance.

Based on the previous comments, the selection of a mttallic abrasion resistant alloy depends upon the end use, where one must consider not only the section size, but the corrosiveness of the liquid. Since the abrasion resistant cast irons do not possess passive films in the sense of the austenitic stainless steels, they are not very good under acidic conditions. However, if one attempts to use an which does have a fairly stable passive film, the particulates may prevent this film from forming.

It should be noted that many foundries have their own modifications of these three classes of abrasion resistant alloys and often they will select one of their own "alloys" for a particular application. However, from a metallurgical standpoint, the abrasion resistant cast irons can be quite complex containing numerous types of carbides having various morphological characteristics as well as a matrix which can contain martensite, austenite or even the transformation products, pearlite and bainite. Although subtle differences can produce dfffering abrasion resistance, the gains are relatively insignificant.

For pump components, such as impellers and casings, the Type III alloy (25% chromium), is the most widely used. However, based on the preceding discussion, it is very difficult to manufacture, is very brittle and has poor corrosion resistance, particularly at low pH values.

This invention describes a new type of abrasion resistant alloy having superior abrasion resistance as well as superior corrosion resistance compared to the classical ASTM A532 type alloys.

Accordingly, it is an object of this invention to provide an abrasion-corrosion resistant casting alloy comprising the following range of composition:

| | C | Mn | Si | Cr | Cu | N | V | Ti | Mo |
|---|---|---|---|---|---|---|---|---|---|
| % min. | 0.1 | 3.0 | 1.0 | 26.0 | 1.0 | 0.3 | 0.5 | 0.5 | 1.0 |
| % max. | 0.5 | 7.0 | 5.0 | 34.0 | 2.0 | 0.7 | 1.5 | 1.5 | 3.0 |

with the balance being Fe; and substantially the following anticipated heat treatment:

1. Solution treat at 2050° F. (1121° C.) to 2250° (1232° C.) for 1 hour per inch of thickness followed by a suitable quench, for example oil, or accelerated air cool.

2. Heat to 1600° F. (871° C.) to 1800° F. (982° C.) for 6 hours.

3. Furnace cool from the temperature in step 2, at a maximum rate of 50° F./hour to the range of 1100° F. (593° C.) to 1200° F., (648° C.) followed by cooling in still air.

DESCRIPTION OF THE PREFERRED EMBODIMENT

Figure 1:
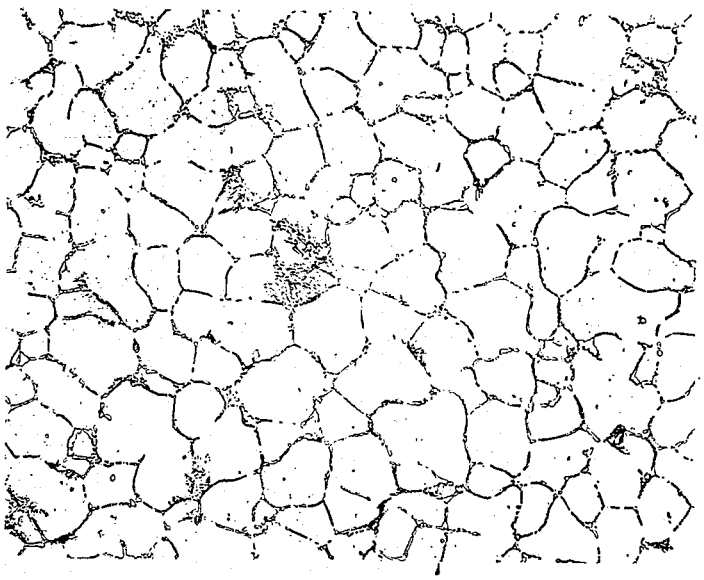
FIG. 1 is a photomicrograph showing the as-cast microstructure of the alloy according to the present invention. Magnification 100×. Etchant: 10% Oxalic Acid-Electrolytic.

The abrasion-corrosion resistant alloy according to this invention, contains a nominal 30% chromium, 5% manganese, 2% molybdenum, 3% silicon, 1.5% copper, 1% titanium, 1% vanadium, 0.3% carbon and 0.5% nitrogen. This combination of elements, with the proper heat treatment, produces an alloy containing a microstructure consisting of approximately a 50/50 mixture of austenite and ferrite. Since it contains no martensite, as in the classical alloys, the high hardness required for abrasion resistance is the result of numerous precipitated carbides, nitrides, combinations of the two and copper. As a result, the solution treated alloy contains only moderate amounts of precipitates and ferrite and can be readily machined.

In the abrasion resistant alloys described in ASTM A532, the carbon content ranges from 2.0 to 3.7%. With this high level of carbon, the martensite is a high carbon martensite, which is very brittle, and with this amount of carbon, a large percentage of the chromium is tied up as chromium carbides, which results in poor corrosion resistance.

The alloy according to this invention is a completely new approach to abrasion resistance, with the following embodiments:

1. Nitrogen is substituted for the carbon. The primary reason for this is that nitrogen, for a given addition level, is not as detrimental as carbon in reducing ductility. However, it does combine with chromium, vanadium and titanium to form stable nitrides and carbonitrides.

2. Since the solubility of nitrogen in unalloyed steel is very low, alloying elements are required to increase the solubility. Alloying elements which have a marked effect (positive) on the solubility of nitrogen in liquid steel are chromium, manganese and vanadium, with carbon and silicon being negative. With 25 to 30% chromium, the solubility of nitrogen in steel is only about 0.35%. The addition of 5% manganese and 1% vanadium increases the solubility up to about 0.5%. Since nitrogen is a very strong austenite stabilizing element and manganese a weaker but contributing austenite stabilizer, with the ratio of austenite and ferrite stabilizing elements in this alloy, the stable room temperature microstructure, (with a suitable heat treatment), consists of an approximate 50/50 mixture of austenite and ferrite. One distinct advantage of the duplex austenite-ferrite matrix and the precipitated phases is that the hardness is uniform throughout the section. As stated earlier, with the classical martensitic alloys, the depth of martensite formation is limited due to the limited hardenability, which results in decreased erosion resistance as a function of depth.

3. Although the corrosion resistance of austenitic stainless steels is due primarily to the formation of a 3. chromium oxide layer, the addition of nitrogen and molybdenum has a strong positive effect on the stability of this passive film. As a result the invention described in this disclosure, exhibits superior corrosion resistance compared to the classical ASTM A532 alloys.

4. Since the as-heat-treated austenitic-ferritic structure contains no hard martensite, the combined addition of titanium, vanadium, nitrogen and carbon, with a suitable high temperature heat treatment, produces precipitation of numerous nitrides, carbides and carbonitrides, with a corresponding increase in hardness.

5. To further increase the hardness, a nominal 1.5% copper is added, which with a low temperature aging treatment increases the hardness by virtue of the classical copper precipitates.

HEAT TREATMENT

It should be realized that, although the alloying elements have been selected for optimum properties, the heat treatment used is a mandatory requirement to produce the desired properties. As can be seen from the as-cast microstructure shown in FIG. 1, the matrix phase of ferrite contains a network of grain boundary precipitates, which are carbides, nitrides and carbonitrides.

Figure 2:
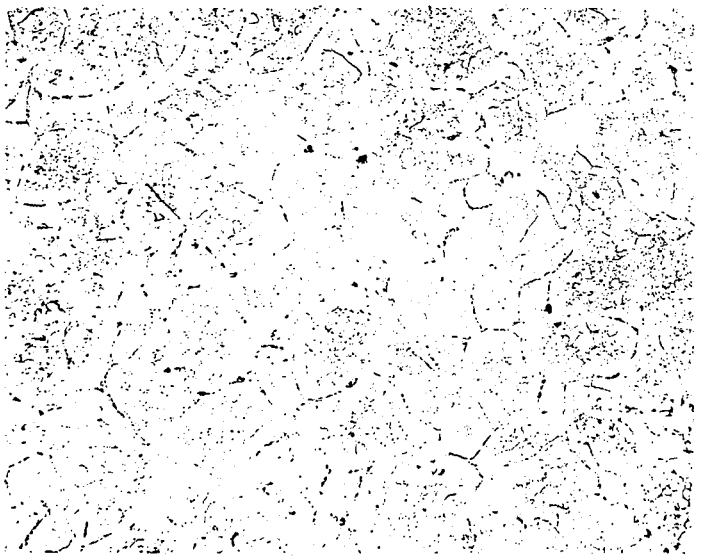
FIG. 2 is a photomicrograph of the alloy according to the present invention showing the microstructure after solution treatment at 2125° F., (1163° C.) followed by an oil quench. Magnification 100×. Etchant: 10% Oxalic Acid-Electrolytic.

The unique heat treatment consists of three steps. The first step is a high temperature treatment at about 2125° F. (1163° C.), to place in solution the carbides, nitrides and carbonitrides and to spherodize those which do not dissolve. This step must be followed by a suitable quench, i.e., oil or an accelerated air cool. At this point, the structure consists of ferrite, with some grain boundary precipitates and a hardness of about 30–31 Rockwell C (285 Brinell). This is illustrated in FIG. 2. As can be seen, most of the grain boundary precipitates are gone.

Figure 3:
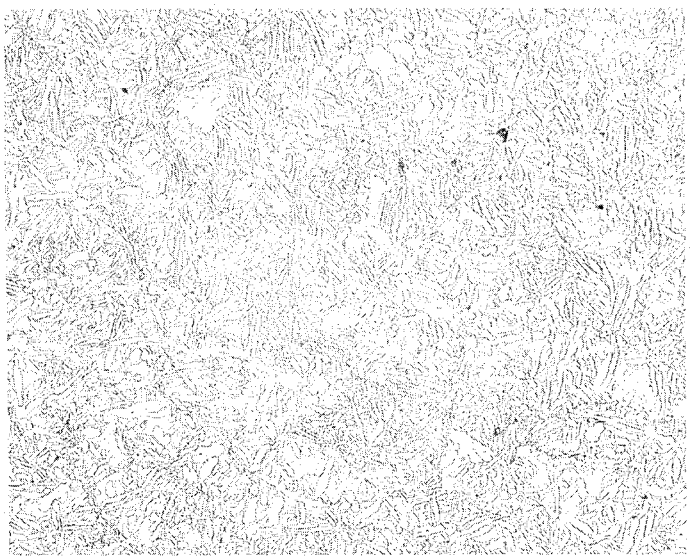
FIG. 3 is a photomicrograph of the alloy according to the present invention showing the microstructure after 6 hours at 1700° F. (927° C.) Magnification 100×. Etchant: 10% Oxalic Acid-Electrolytic.

The second step of this heat rreatment consists of heating to 1700° F. (927° C.) for 6 hours, where diffusional processes can take place and which is the driving force for the matrix precipitation of various carbides, nitrides and carbonitrides, as well as the step which produces the duplex austenitic-ferritic structure. This is illustrated in FIG. 3. At this point, the hardness is about 47–48 Rockwell C (450 Brinell).

The third step involves a furnace cool from 1700° F. (927° C.), with a rate not to exceed 50° F./hr, to a range of 1100° F. (593° C.), to 1125° F. (607° C.), Where copper can precipitate. This increases the hardness to about 51 to 53 Rockwell C (520 Brinell). During this step, there is very little change in the structure and thus the morphology is similar to that shown in FIG. 3.

As the following data show, this unique combination of alloying elements and heat treatment produces an alloy with remarkable abrasion-corrosion resistance.

CHEMISTRY

The chemical composition of the new alloy according to the present invention has an anticipated range of the following percentages of critical elements:

| | C | Mn | Si | Cr | Cu | N | V | Ti | Mo |
|---|---|---|---|---|---|---|---|---|---|
| % min. | 0.1 | 3.0 | 1.0 | 26.0 | 1.0 | 0.3 | 0.5 | 0.5 | 1.0 |
| % max. | 0.5 | 7.0 | 5.0 | 34.0 | 2.0 | 0.7 | 1.5 | 1.5 | 3.0 |

with the balance being Fe.

The alloy has a preferred range of critical elements of:

| | C | Mn | Si | Cr | Cu | N | V | Ti | Mo |
|---|---|---|---|---|---|---|---|---|---|
| % min. | 0.2 | 4.0 | 2.0 | 28.0 | 1.3 | 0.4 | 0.8 | 0.8 | 1.5 |
| % max. | 0.4 | 6.0 | 4.0 | 32.0 | 1.7 | 0.6 | 1.2 | 1.2 | 2.5 |

with the balance being Fe.

The alloy has a specific composition of critical elements as follows:

| C | Mn | Si | Cr | Cu | N | V | Ti | Mo |
|---|---|---|---|---|---|---|---|---|
| 0.3 | 5.0 | 3.0 | 30.0 | 1.5 | 0.5 | 1.0 | 1.0 | 2.0 |

with the balance being Fe.

The alloy as described above having the prescribed chemical composition requires the following heat treatment to obtain the desired microstructure and properties.

ANTICIPATED RANGE OF HEAT TREATMENT

1. Solution treat at 2050° F. (1121° C.), to 2250° (1232° C.) for 1 hour per inch of thickness followed by a suitable quench, for example oil, or accelerated air cool.

2. Heat to 1600° F. (871° C.) to 1800° F. (982° C.) for 6 hours.

3. Furnace cool from the temperature in step 2, at a maximum rate of 50° F./hour to the range of 1100° F. (593° C.) to 1200° F. (982° C.), followed by cooling in still air.

SPECIFIC RECOMMENDATION OF HEAT TREATMENT

1. Solution treat at 2125° F. (1162° C.) for 1 hour per inch of thickness followed by an oil quench or accelerated air cool.

2. Heat to 1700° F. (927° C.) for 6 hours.

3. Furnace cool from 1700° F. (927° C.) at 50° F./hour to 1125° F. (607° C.) followed by cooling in still air.

ABRASION RESISTANCE

The abrasion resistance of the new alloy, compared to the classical ASTM A532 Class III 25% chromium alloy, is given in Table I. These tests are weight loss in a test fixture using glass beads directed at the sample using a suitable nozzle at an air pressure of 80 psi. The test duration was 5 minutes.

TABLE I

| Material | Hardness | Weight Loss |
|---|---|---|
| 25% Chromium (ASTM A532 Class III) | 58 Rockwell C | 0.0449 grams |
| New Alloy | 53 Rockwell C | 0.0442 grams |

The chemical contents of the two alloys used for the tests shown in Table I are as follows:

| C | Mn | Si | Cr | Cu | N | V | Ti | Mo |
|---|---|---|---|---|---|---|---|---|
| 1. 25% Chromium-ASTM A532 Class III. | | | | | | | | |
| 2.71 | 0.93 | 0.46 | 26.68 | 0.01 | 0.18 | 0.06 | 0.01 | 0.01 |
| 2. New Alloy. | | | | | | | | |
| 0.33 | 4.04 | 2.88 | 30.79 | 1.38 | 0.34 | 1.06 | 0.84 | 1.90 |

CORROSION RESISTANCE

Figure 4:
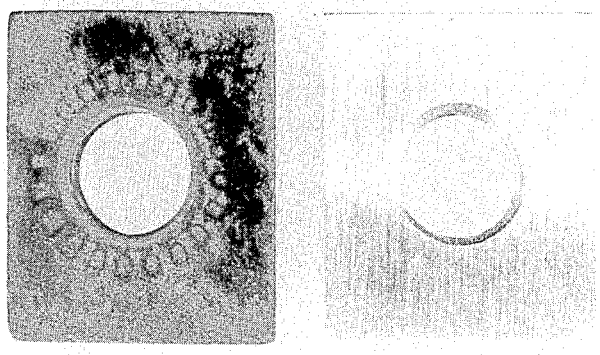
FIG. 4 is a photo showing comparison results of ferric chloride multiple crevice assembly test. Test duration, 5 days at room temperature. Magnification 1.9×.

As discussed earlier, one of the most serious problems with the classical abrasion resistant alloys is the lack of corrosion resistance at low pH values. In the more recent scrubber applications, where the low pH is aggravated by the presence of chlorides, these alloys have very poor performance when used for, example, in pumps. The most commonly used laboratory test for determining the localized corrosion resistance in aerated chloride containing liquids is ASTM G48, which utilizes a crevice assembly in a 10% ferric chloride solution, with a pH of about 1.5. FIG. 4 shows the results of a five day test in this solution at room temperature. As can be seen, the classical ASTM A532 Class III alloy, the chemistry of which is given in Table I, suffers severe general corrosion as well as localized corrosion. A metallographic assessment of this sample shows the corrosion to be similar to "graphitization" in cast iron, which is essentially a galvanic type of corrosion between the iron matrix and graphite. In this alloy, the galvanic cell is between the iron matrix and iron carbides. Also, as can be seen in the photograph, the new alloy described in this disclosure shows no visible signs of corrosion.

THERMAL SHOCK RESISTANCE

A serious problem with the classical abrasion resistant alloys, particularly with the Class III alloy, is the extremely low thermal shock resistance. To determine the shock resistance of the new alloy compared to the classical 25% chromium Class III alloy, a series of quenching tests was conducted. The following table summarizes the results of these tests.

TABLE II

| Material | Quenchant | Temperature | Results |
|---|---|---|---|
| Test Number 1 | | | |
| 25% Chromium (ASTM A532 Class III) | Oil | 2100° F. (1149° C.) | Cracked |
| New Alloy | Oil | 2100° F. (1149° C.) | No cracks |

In the following tests, the New Alloy was heated to the temperatures indicated and quenched directly into 500 ml of distilled water at room temperature.

| Material | Quenchant | Temperature | Results |
|---|---|---|---|
| Test number 2 | | | |
| New Alloy 56 Rockwell C | Room Temp. Distilled Water | 110° F. (43° C.) | No Cracks |
| | | 211° F. (99° C.) | No Cracks |
| | | 311° F. (155° C.) | No Cracks |
| | | 406° F. (208° C.) | No Cracks |
| | | 503° F. (262° C.) | Slight Surface Craze Cracks |

Having described my new alloy in terms of a preferred embodiment, variation may occur to one skilled in the art. I therefore do not wish to be limited in the scope of my invention except as claimed:

I claim:

1. An alloy composed of the following range of chemistry of critical elements:

| | C | Mn | Si | Cr | Cu | N | V | Ti | Mo |
|---|---|---|---|---|---|---|---|---|---|
| % min. | 0.1 | 3.0 | 1.0 | 26.0 | 1.0 | 0.3 | 0.5 | 0.5 | 1.0 |
| % max. | 0.5 | 7.0 | 5.0 | 34.0 | 2.0 | 0.7 | 1.5 | 1.5 | 3.0 |

with the balance being Fe; and said alloy having the following range of heat treatment:

subjecting said alloy to a solution treatment at 2050° F. (1121° C.) to 2250° F. (1232° C.) for 1 hour per inch of thickness followed by a suitable quench, or accelerated air cool; followed by heating the alloy to 1600° F. (871° C.) to 1800° F. (982° C.) and soaking the alloy for 6 hours; followed by furnace cooling of the alloy from the soaking temperature at a maximum rate of 50° F./hour to the range of 1100° F. (593° C.) to 1200° F. (982° C.) followed by cooling of the alloy in still air.

2. An alloy consisting of the following preferred range of chemistry of critical elements:

| | C | Mn | Si | Cr | Cu | N | V | Ti | Mo |
|---|---|---|---|---|---|---|---|---|---|
| % min. | 0.2 | 4.0 | 2.0 | 28.0 | 1.3 | 0.4 | 0.8 | 0.8 | 1.5 |
| % max. | 0.4 | 6.0 | 4.0 | 32.0 | 1.7 | 0.6 | 1.2 | 1.2 | 2.5 |

with the balance being Fe; and said alloy having the following range of heat treatment:

subjecting said alloy to a solution treatment at 2050° F. (1121° C.) to 2250° F. (1232° C.) for 1 hour per inch of thickness followed by a suitable quench or accelerated air cool; followed by heating the alloy to 1600° F. (871° C.) to 1800° F. (982° C.) and soaking the alloy for 6 hours followed by furnace cooling of the alloy from the soaking temperature at a maximum rate of 50° F./hour to the range of 1100° F. (593° C.) to 1200° F. (892° C.) followed by cooling of the alloy in still air.

3. An abrasion corrosion resistant casting alloy consisting of the following chemistry of critical elements:

| C | Mn | Si | Cr | Cu | N | V | Ti | Mo |
|---|---|---|---|---|---|---|---|---|
| 0.3 | 5.0 | 3.0 | 30.0 | 1.5 | 0.5 | 1.0 | 1.0 | 2.0 |

with the balance being Fe; and said alloy having the following range of heat treatment:

subjecting said alloy to a solution treatment at 2050° F. (1121° C.) to 2250° F. (1232° C.) for 1 hour per inch of thickness followed by a suitable oil quench, or accelerated air cool; followed by heating the alloy to 1600° F. (871° C.) to 1800° F. (982° C.) and soaking the alloy for 6 hours; followed by furance cooling of the alloy from the soaking temperature at a maximum rate of 50° F./hour to the range of 1100° F. (593° C.) to 1200° F. (982° C.) followed by cooling of the alloy in still air.

4. An alloy according to claim 1 having been subjected to the following specific heat treatment:

solution treating the alloy at 2125° F. (1163° C.) for 1 hour per inch of thickness followed by an oil quench or accelerated air cool; followed by heating to 1700° F. (927° C.) for 6 hours; followed by furnace cooling from 1700° F. (927° C.) at 50° F./hour to 1125° F. (607° C.); followed by cooling the alloy in still air.

5. An alloy according to claim 2 having been subjected to the following specific heat treatment:

solution treating the alloy at 2125° F. (1163° C.) for 1 hour per inch of thickness followed by an oil quench or accelerated air cool; followed by heating to 1700° F. (927° C.) for 6 hours; followed by furnace cooling from 1700° F. (927° C.) at 50° F./hour to 1125° F. (607° C.); followed by cooling the alloy in still air.

6. An alloy according to claim 3 having been subjected to the following specific heat treatment:

solution treating the alloy at 2125° F. (1163° C.) for 1 hour per inch of thickness followed by an oil quench or accelerated air cool; followed by heating to 1700° F. (927° C.) for 6 hours; followed by furnace cooling from 1700° F. (927° C.) at 50° F./hour to 1125° F. (607° C.); followed by cooling the alloy in still air.

7. An abrasion-corrosion resistant casting alloy according to claim 3 wherein said alloy is in the form of a casting.

8. An abrasion-corrosion resistant casting according to claim 7, wherein said casting is in the form of a pump casing.

9. An alloy according to claim 1 wherein said alloy is in the form of a casting.

10. An alloy according to claim 9 wherein said casting is in the form of a pump casing.

* * * * *